United States Patent [19]

Franke

[11] 4,131,797

[45] Dec. 26, 1978

[54] X-RAY DIAGNOSTIC INSTALLATION FOR FLUOROSCOPY AND PHOTOGRAPHY

[75] Inventor: Kurt Franke, Erlangen, Germany

[73] Assignee: Siemens Aktiengesellschaft, Berlin & Munich, Germany

[21] Appl. No.: 856,318

[22] Filed: Dec. 1, 1977

[30] Foreign Application Priority Data

Dec. 10, 1976 [DE] Fed. Rep. of Germany ..... 2656047

[51] Int. Cl.[2] ..... H05G 1/58

[52] U.S. Cl. ..... 250/322; 250/413; 250/460

[58] Field of Search ..... 250/322, 460, 415, 413

[56] References Cited

U.S. PATENT DOCUMENTS

| | | | |
|---|---|---|---|
| 3,586,860 | 6/1971 | Borjesson et al. | 250/322 |
| 3,991,314 | 11/1976 | Schmitman et al. | 250/413 |

*Primary Examiner*—Alfred E. Smith
*Assistant Examiner*—T. N. Grigsby
*Attorney, Agent, or Firm*—Hill, Gross, Simpson, Van Santen, Steadman, Chiara & Simpson

[57] ABSTRACT

In an illustrated embodiment, a switch control handle is shiftable from an upper position to a lower position to disconnect the fluoroscopic x-ray voltage and condition the circuitry for a transition to photographic exposure. Further downward shifting connects the x-ray high voltage until the automatic exposure control terminates the exposure. By coupling the control handle to a selector switch, a single manually adjustable set point potentiometer may select the fluoroscopy voltage set point in the upper position of the handle while adjusting the exposure time for patient constitution in the lower position.

1 Claim, 3 Drawing Figures

X-RAY DIAGNOSTIC INSTALLATION FOR FLUOROSCOPY AND PHOTOGRAPHY

BACKGROUND OF THE INVENTION

The invention relates to an x-ray diagnostic installation for fluoroscopy and photography comprising a regulating element for the fluoroscopic x-ray tube voltage, an automatic exposure timer for determining the photographic time, a radiation measuring chamber for sensing the dose rate impinging on the x-ray film, as well as a switch-off stage for switching off the x-ray tube upon attaining a predetermined dose, and a switch for the purpose of switching over from fluoroscopy to photography, and a positioning or set point element for the purpose of adjusting the switch-off dose of the automatic exposure timer.

In a known x-ray diagnosis installation of this type, two positioning elements are present, one of which serving the purpose of adjusting the fluoroscopic x-ray tube voltage in the course of a fluoroscopic examination, and the other serving the purpose of adapting the automatic exposure timer to the constitution of the respective patent prior to a photograph; i.e., adjusting the switch-off dose. The known x-ray diagnosis installation contains a large number of operating members so that operation is complex.

SUMMARY OF THE INVENTION

The object which is the basis of the invention consists in producing an x-ray diagnostic installation of the type initially cited wherein the number of operating members is reduced as compared with the state of the art and operation of the installation is consequently simplified.

The solution of this problem was preceded by the recognition that the positioning or set point element for the fluoroscopic x-ray tube voltage is no longer used during an x-ray photographic procedure and directly prior to initiation of an x-ray photograph, and that a different task can be assigned to said positioning element for this time interval, namely the adjustment of the automatic exposure timer.

Accordingly, the object underlying the invention is solved by virtue of the fact that the switch for switching over from fluoroscopy to photography is constructed in such a manner that the positioning element for the fluoroscopic x-ray tube voltage is capable of being connected to the automatic exposure timer for adjusting the switch-off dose during transition to photography, in response to actuation of the switch.

Other objects, features and advantages of the invention will be apparent from the following detailed description taken in connection with the accompanying sheet of drawings.

DETAILED DESCRIPTION

Figure 1:
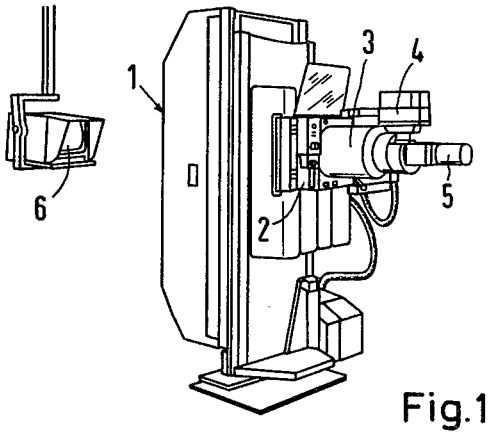
FIG. 1 illustrates a prospective view of an x-ray diagnosis installationn in accordance with the invention.

In FIG. 1, an x-ray diagnostic installation is illustrated manifesting a shiftable x-ray apparatus 1 for supporting the patient, a sighting device 2 for preparing direct photographs, an x-ray image intensifier 3 and a camera 4 for preparing indirect photographs. The x-ray diagnostic installation according to FIG. 1 makes it possible to pick up x-ray images by means of a television camera 5 from the outlet fluorescent screen of image intensifier 3 and to reproduce the latter images by means of a visual display unit 6; i.e., to carry out a fluoroscopic examination of the patient.

Figure 2:
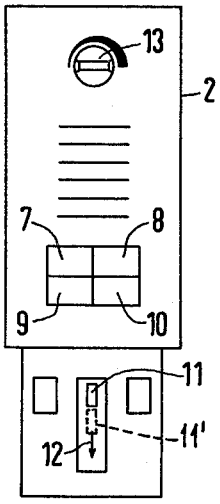
FIG. 2 illustrates a detail of the installation in accordance with FIG. 1.

According to FIG. 2, sighting device 2 possesses switches 7, 8, 9, 10 disposed on a commmand arm for the purpose of selecting the respective photographic program for direct photographs; i.e., for selecting the subdivision of the film format of the film disposed in the photographic cassette. For example, by means of switch 7, a full image is selectable making complete use of the film format; by means of switch 8, for example, two individual images are selectable; and by means of switch 9, three individual images are selectable (by means of longitudinal division of the film); and by means of switch 10, four individual pictures are selectable (by means of longitudinal and transverse division of the film in the respective photographic cassette). In addition, the sighting device 2 is provided with a handle 11 which is shiftable to a lower position 11′ and then is capable of further downward movement in the direction of arrow 12. In the solid line position of handle 11, the installation is switched to fluoroscopy. The fluoroscopic x-ray tube voltage is manually adjustable here by means of a manual turning of rotary knob 13.

If handle 11 is in its lower postion 11′, the fluoroscopic voltage is switched off; if handle 11 is then moved further in the direction of arrow 12, a switch-over is effected to x-ray tube voltage for photography and it is possible to prepare x-ray photographs by means of the sighting device 2 or camera 4. Knob 13 is connected into the automatic x-ray exposure timer when handle 11 is in its lower position 11′, and the timer then switches off the x-ray tube upon attaining a predetermined dose. The connection proceeds in such a fashion that, by means of knob 13, an adaptation of the automatic exposure timer to the patient's constitution is possible with handle 11 in position 11′. This shall be explained in greater detail on the basis of FIG. 3.

Figure 3:
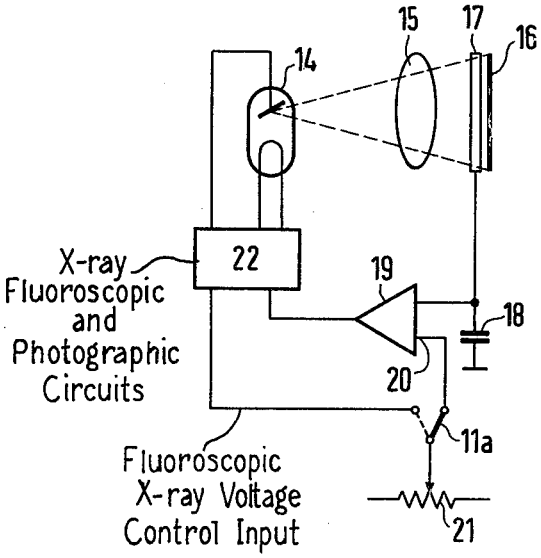
FIG. 3 illustrates a circuit diagram for explaining the invention.

FIG. 3 illustrates an x-ray tube 14 which irradiates a patient 15 and prepares photographs on a film 16. Disposed in front of film 16 there is a measuring chamber 17 of the automatic exposure timer, whose output signal is integrated in a capacitor 18. The signal at capacitor 18, corresponding to the respective dose on film 16, is conveyed to a trigger element or threshold value comparator 19 whose trigger threshold is adjustable at input 20 by means of an adjustment resistance or set point element 21. When trigger element 19 switches over, a switching off of x-ray tube 14 takes place. For this purpose, trigger element 19 is connected to control the high voltage supply circuit 22.

The adjustment resistance 21 is actuatable by means of knob 13 such that, through knob 13, in the illustrated position of switch 11*a*, the automatic exposure timer is adaptable to the respective patient constitution while the threshold of the trigger element 19 is adjusted. The fully illustrated position of switch 11*a*, which is actuatable by means of handle 11, thus corresponds to the lower position 11′ of handle 11; i.e., the photography procedure. If handle 11 is moved back into its solid line position in FIG. 2 (fluoroscopy procedure), switch 11*a* is changed over into its position illustrated by broken lines. In the latter position, adjustment resistance 21 is connected to high voltage generator 22 such that the fluoroscopic x-ray tube voltage is adjustable by means of knob 13. U.S. Pat. No. 3,991,314 shows a fluoroscopic x-ray voltage adjustment circuit in the third figure which has a manual set point element designated by reference numeral sixty-three in this figure.

It will be apparent that many modifications and variations may be effecfed without departing from the scope of the novel concepts and teachings of the present invention.

I claim as my invention:

1. An x-ray diagnostic installation for fluoroscopy and photography, comprising a fluoroscopic voltage adjustment means for adjusting fluoroscopic x-ray voltage, radiation measuring means for sensing the dose rate during photography, an automatic exposure timer for determining photographic time, connected with the radiation measuring means, and operable for switching off the x-ray energy upon attaining a predetermined dose, and a switch for switching over from fluoroscopy to photography, characterized in that a common adjustable set point slement is connected with the fluoroscopic voltage adjusting means for controlling the fluoroscopic voltage while the switch is conditioned for fluoroscopy, and is connectable to the automatic exposure timer for adjustment of the switch-off dose during transition to photography in response to actuation of said switch to switch over to photography.

* * * * *